US006543159B1

(12) United States Patent
Carpenter et al.

(10) Patent No.: US 6,543,159 B1
(45) Date of Patent: Apr. 8, 2003

(54) SNOWBOARD BOOT AND BINDING STRAP

(75) Inventors: Jake Burton Carpenter, Stowe, VT (US); Paul T. Maravetz, Grand Isle, VT (US); Thomas McGann, Jerico Center, VT (US); David J. Dodge, Williston, VT (US); John Gerndt, Burlington, VT (US); Stefan Reuss, Innsbruck (AT)

(73) Assignee: The Burton Corporation, Burlington, VT (US)

( * ) Notice: Subject to any disclaimer, the term of this patent is extended or adjusted under 35 U.S.C. 154(b) by 1120 days.

(21) Appl. No.: 08/619,358

(22) Filed: Mar. 21, 1996

(51) Int. Cl.[7] ..... A43B 5/00

(52) U.S. Cl. ..... 36/115; 36/117.1; 36/50.5; 36/88

(58) Field of Search ..... 36/50.1, 50.5, 36/88, 92, 115, 116, 117.1, 117.9

(56) References Cited

U.S. PATENT DOCUMENTS

| | | | | |
|---|---|---|---|---|
| 3,241,153 A | | 3/1966 | Brewer | |
| 3,516,180 A | | 6/1970 | Thurston | |
| 3,545,103 A | | 12/1970 | Bloomfield et al. | |
| 3,657,827 A | | 4/1972 | Rieker | |
| 3,747,239 A | | 7/1973 | Green | |
| 3,751,832 A | | 8/1973 | Baryluk | |
| 4,030,215 A | * | 6/1977 | Vogel | 36/117.9 |
| 4,080,745 A | * | 3/1978 | Torrance | 36/50.1 |
| 4,282,657 A | * | 8/1981 | Antonious | 36/50.1 |

(List continued on next page.)

FOREIGN PATENT DOCUMENTS

| | | | |
|---|---|---|---|
| CH | 214531 | | 3/1940 |
| CH | 244825 | | 8/1945 |
| CH | 264893 | | 6/1948 |
| CH | 502 828 A | | 2/1971 |
| DE | 916696 | | 7/1954 |
| DE | 91 13 766 U | | 2/1997 |
| DE | 196 03 790 A | | 4/1997 |
| DE | 196 42887 A1 | | 4/1997 |
| EP | 0 217 750 | | 4/1987 |
| EP | 0646334 | * | 4/1995 |
| EP | 0 705 544 A1 | | 4/1996 |
| EP | 0 705 625 A1 | | 4/1996 |
| EP | 0 753 267 A1 | | 1/1997 |
| EP | 0 770 413 A1 | | 5/1997 |
| EP | 0 774 217 A2 | | 5/1997 |
| JP | 3004426 | | 11/1994 |
| JP | 7-171002 | | 7/1995 |
| JP | 8-266307 | | 10/1996 |
| NO | 60109 | | 9/1937 |
| WO | WO 94/21149 | | 9/1994 |
| WO | WO 95/09035 | | 4/1995 |
| WO | WO 96/01575 | | 1/1996 |
| WO | WO 97/17860 | | 5/1997 |

OTHER PUBLICATIONS

Pages from a DNR Sportsystem Ltd. Catalog.
Pages from a Flow Catalog.
International Search Report dated Oct. 24, 1997.
Utility Model Technology Assessment Jan. 12, 1998.

*Primary Examiner*—M. D. Patterson
(74) *Attorney, Agent, or Firm*—Wolf, Greenfield & Sacks, P.C.

(57) ABSTRACT

One aspect of the invention is a removable strap for a snowboard boot to preventing the rider's foot from lifting in the boot. The ankle strap enables a soft boot to be used with both a strap-less step-in binding system, and a strap binding system. Another aspect is a snowboard binding including a strap adapted to releasably secure the snowboard boot and constructed and arranged to avoid creation of a pressure point at an instep bone of the rider. A further aspect is an apparatus comprising a snowboard boot and a strap attached thereto. The strap is arranged to prevent the rider's heel from lifting in the snowboard boot, and is constructed and arranged to avoid creation of a pressure point at an instep bone of the rider.

57 Claims, 11 Drawing Sheets

U.S. PATENT DOCUMENTS 4,296,558 A * 10/1981 Antonious ..... 36/50.1
4,387,517 A 6/1983 Annovi
4,662,082 A 5/1987 Shabazz
4,669,202 A 6/1987 Ottieri
4,741,550 A * 5/1988 Dennis ..... 280/618
4,979,760 A 12/1990 Derrah
5,044,654 A * 9/1991 Meyer ..... 280/613
5,172,924 A 12/1992 Barci
5,234,230 A 8/1993 Crane et al.
5,312,258 A 5/1994 Giorgio
5,368,320 A 11/1994 Teeter et al.
5,381,612 A * 1/1995 Paris ..... 36/117.9
5,409,244 A 4/1995 Young
5,416,952 A 5/1995 Dodge
5,435,080 A 7/1995 Meiselman
5,459,949 A 10/1995 MacPhail
5,474,322 A 12/1995 Perkins et al.
5,480,176 A 1/1996 Sims
5,493,793 A 2/1996 Pozzobon et al.
5,499,461 A * 3/1996 Danezin et al. ..... 36/117.1
5,505,477 A 4/1996 Turner et al.
5,570,522 A * 11/1996 Olson et al. ..... 36/115

* cited by examiner

SNOWBOARD BOOT AND BINDING STRAP

BACKGROUND OF THE INVENTION

1. Field of the Invention

The present invention relates to a removable strap for a snowboard boot to prevent the rider's foot from lifting in the boot, and an ankle strap for use in a snowboard boot or binding.

2. Description of Related Art

Snowboarding has become increasingly popular as a recreational sport. A snowboard typically includes bindings that attach the rider's feet to the board. Three main types of bindings have been developed.

A first type of binding is adapted to be used with a hard boot, which is similar to an alpine ski boot. Typically, the boot includes a hard plastic molded shell, and is securely mounted on the board via a plate binding that includes rear and forward bails that engage the boot. Hard boots provide support for the rider's foot, in that a properly sized boot will not allow the rider's foot to move therein, and will typically prevent the heel from lifting from the bottom of the boot.

A second type of binding is adapted for use with a soft boot, which, as the name suggests, is at least partially made of a softer material than hard boots. The typical binding used for soft boots has a rigid high back piece into which the heel of the boot is placed, and one or more straps that secure the boot to the binding. Such bindings can be somewhat inconvenient to use because after each run, the rider must unbuckle each strap to release the boot when getting on the chair lift, and must re-buckle each strap before the next run.

A third type of binding that has recently been developed for use with a soft boot eliminates the need for binding straps and provides the convenience of a step-in system. An example of such a binding system is disclosed in currently pending U.S. patent application Ser. No. 08/584,053, entitled METHOD AND APPARATUS FOR INTERFACING A SNOWBOARD BOOT TO A BINDING, filed Jan. 8, 1996 and assigned to Burton Snowboards. Soft boot step-in bindings are more convenient than conventional strap bindings, making it easier to engage and disengage the rider's boots from the board.

The development of soft boot step-in binding systems has presented a problem not previously encountered. In particular, tremendous lifting forces are generated at the feet of a snowboard rider. It is desirable to prevent the rider's foot, particularly the heel, from lifting from the bottom of the boot to maximize control. In a hard boot plate binding system, the boot is generally sufficiently rigid to hold the rider's foot down and prevent lift. Similarly, in a conventional soft boot strap binding system, the straps are tightened down over the boot and hold the rider's foot down to prevent lift. However, with a strap-less soft boot step-in binding, only the laces of the boot are available to resist lifting, which is often insufficient. Accordingly, it is an object of the present invention to prevent lifting of the rider's foot in a strap-less soft boot step-in binding system.

U.S. Pat. No. 5,435,080 (Meiselman) discloses a strap system for preventing lift in a snowboard boot that is a hybrid of a hard and soft boot. The Meiselman boot has a hard lower portion that is adapted to engage a plate binding and a soft upper portion. In one embodiment the Meiselman boot has a heel strap fixed thereto to prevent heel lift. In another, heel and toe straps are fixed to the boot.

Although the Meiselman straps are said to be effective in preventing lift, they are not used in connection with a soft boot and would suffer a significant disadvantage if they were. In particular, it is desirable for soft boots to be usable with not only the more recently developed step-in binding systems, but also with the more conventional strap bindings. The Meiselman boot is not suited for use with a strap binding system, because the straps fixed thereto would overlap and interfere with the binding straps. Accordingly, it is a further object of the present invention to provide a snowboard boot that prevents lifting of the rider's foot when used in conjunction with a strap-less binding system, but is also compatible with a strap binding.

Straps, whether on a boot or binding, can create uncomfortable pressure points on the rider's foot when tightened. Additionally, if a strap is too wide, it may not conform to the contour of a rider's foot, which can cause the foot to become cramped or pinched in various locations. Accordingly, it is another object of the present invention is to provide a strap that securely fits over a snowboard boot while not creating uncomfortable pressure points.

SUMMARY OF THE INVENTION

In one illustrative embodiment of the present invention, an apparatus is provided that comprises a snowboard boot and a strap that is removably attached thereto and arranged to prevent a rider's foot from lifting in the snowboard boot. In one aspect of this embodiment, the strap is arranged to prevent the rider's heel from lifting in the boot. In another aspect of this embodiment, the snowboard boot has a lateral side and a medial side, and the strap is removably attached at a first location at a first location on the lateral side and a second location on the medial side of the snowboard boot. A buckle may be attached to the strap to adjust the tension in the strap. In another aspect of the invention, the strap may be attached to the boot at first, second and third attachment locations. The first and second attachment locations may be disposed on the medial side of the boot and the third attachment location may be disposed on the lateral side of the boot. Further, the strap may be constructed so that the strap does not apply pressure to the instep bone of the rider.

The present invention also provides a snowboard binding for releasably securing a snowboard boot that includes a strap which is adapted to releasably secure the snowboard boot, the strap being constructed and arranged to avoid the creation of a pressure point at an instep bone of a rider. The strap further may be arranged to prevent a heel of a snowboard boot from lifting from the binding. Additionally, the boot may include a base having a lateral side and a medial side and the strap may be attached at a first location at the lateral side and a second location at the medial side. The strap may have an opening that is positioned to be disposed above the instep bone of the rider. In another aspect of the invention, the strap may be attached to the base at a first, second and third attachment locations, wherein the first and second attachment locations are disposed on the medial side of the binding, and the third attachment location is disposed on the lateral side of the binding. Additionally, the strap attached at three attachment locations may have a Y-shape.

BRIEF DESCRIPTION OF THE DRAWINGS

The foregoing and other objects and advantages of the invention will be appreciated more fully from the description below and the following drawings, in which.

DETAILED DESCRIPTION OF ILLUSTRATIVE EMBODIMENTS OF THE INVENTION

Figure 1:
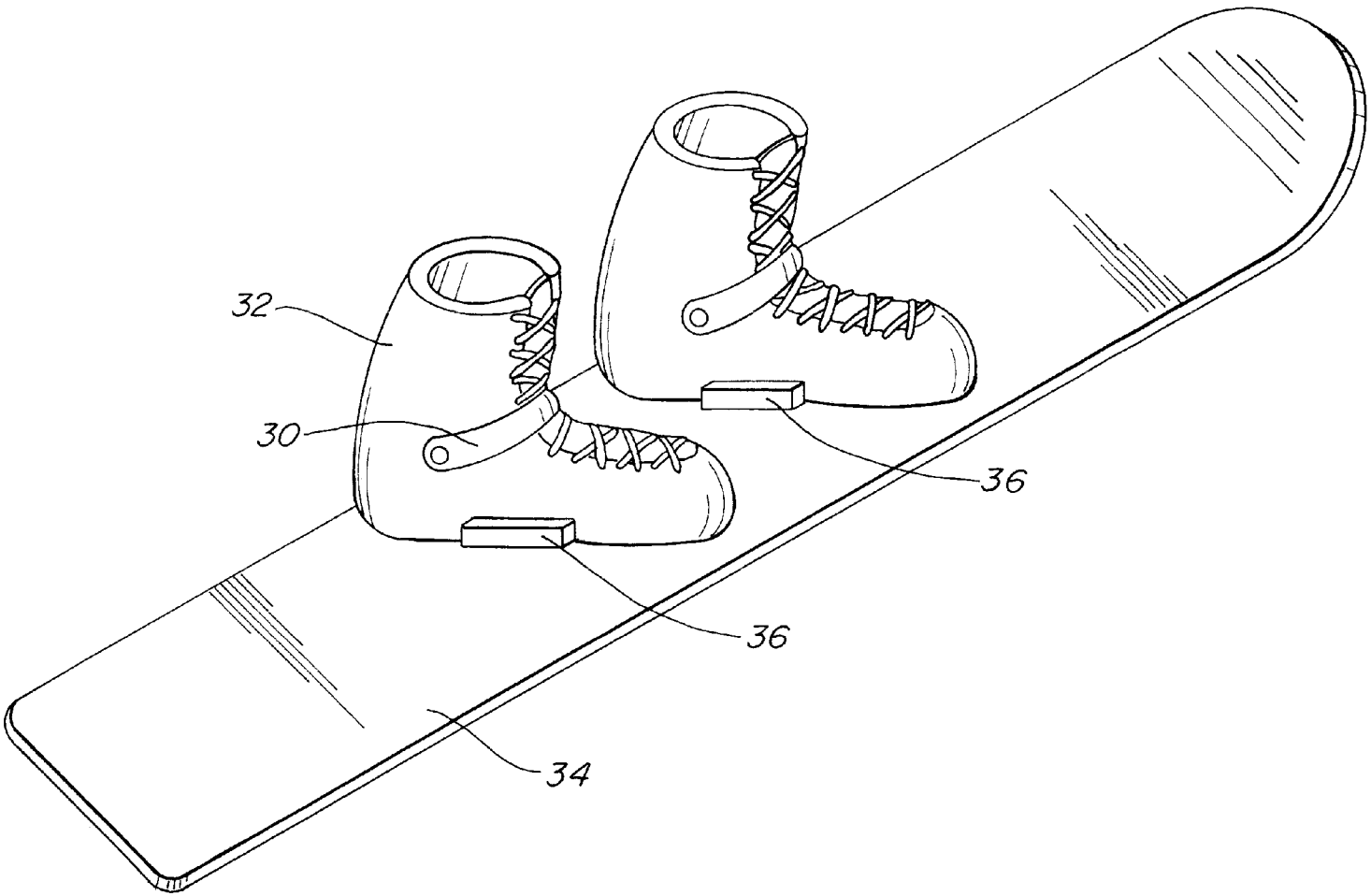
FIG. 1 is an illustration of a boot and ankle strap of the present invention used with a snowboard.

In one illustrative embodiment of the present invention, a strap is provided to hold a rider's heel against the bottom of a snowboard boot. FIG. 1 illustrates one application for this embodiment of the invention, i.e., a soft snowboard boot used with a strap-less step-in binding system. In FIG. 1, the ankle strap 30 is attached to a snowboard boot 32, which is in turn mounted to a snowboard 34 by a binding suggested at 36. As discussed above, the strap is advantageous because it keeps the rider's heel from lifting in the boot, thereby maximizing the rider's maneuverability and control. The strap is constructed to keep the heel seated in the boot even during hard turns and aggressive high-performance maneuvers.

In one embodiment of the invention, the strap is removably attached to the boot in any number of ways as described below. Thus, the strap 30 can be attached when used with a strap-less binding to hold down the rider's foot, and can be removed to enable the boot to be used with a strap binding.

Figures 2A, 3A:
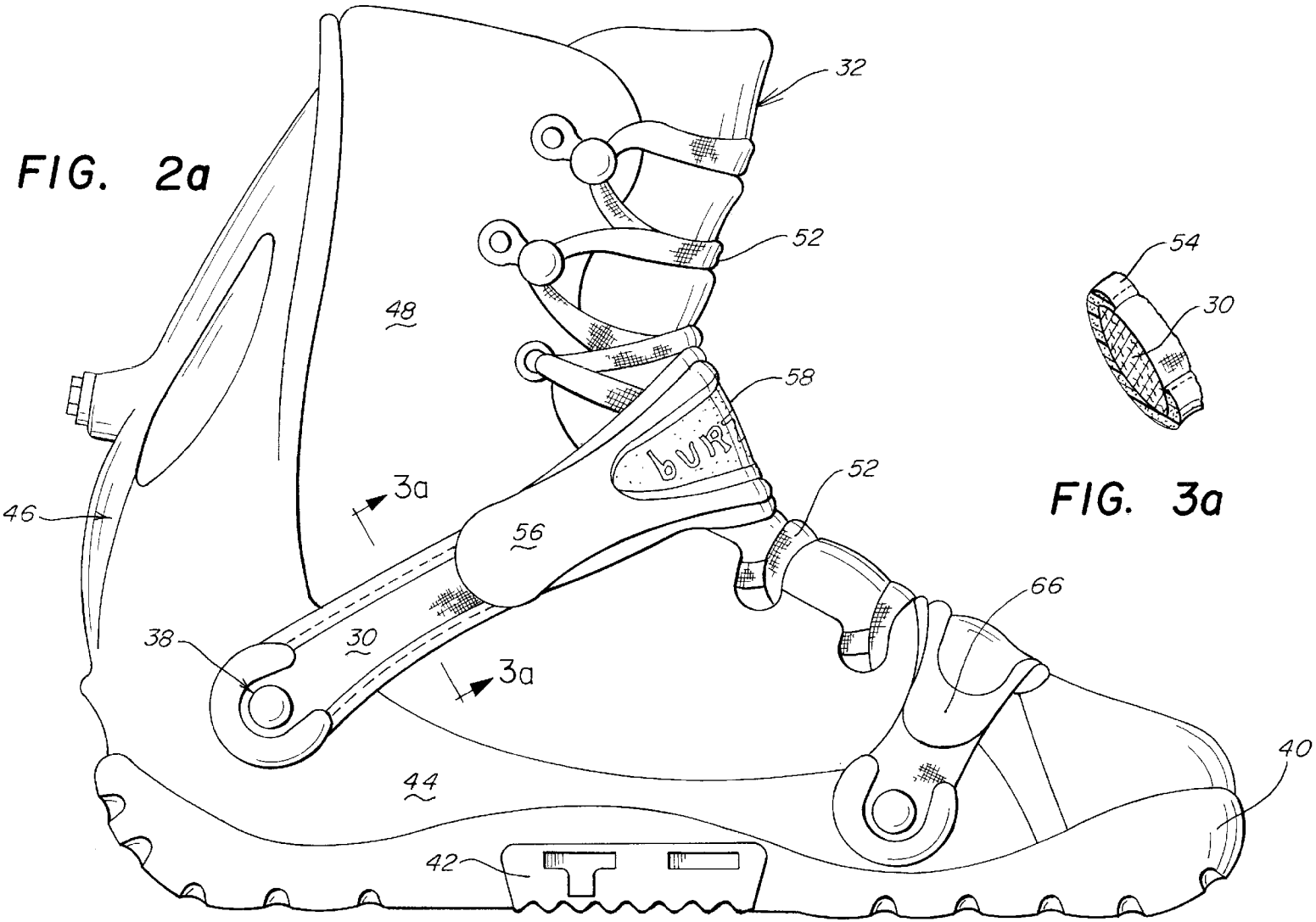
FIG. 2*a* is a medial side view of a boot having straps in accordance with the present invention for securing the rider's foot in the boot.
FIG. 3*a* is a perspective sectional view of the strap shown in FIG. 2 taken along line 3*a*—3*a* in FIG. 2.

FIG. 2*a* illustrates an exemplary boot 32 with a two-point connection strap 30 (only the medial side is shown)in accordance with the present invention attached at location 38 on the boot. Although the strap 30 shown in FIG. 2*a* has two attachment points, it should be understood that the invention is not so limited, and that a plurality of attachment points can be provided on each side of the boot. The boot 32 shown in FIG. 2*a* includes an interface 44, as disclosed in application serial no. 08/584,053, for engaging a step-in binding. However, it should be understood that this invention is not limited to the illustrative construction, and that other arrangements for cooperating with a step-in binding may be employed on the boot.

The boot shown in FIG. 2*a* has a rubber sole 40 to provide traction. The portions 42 of the binding interface at the medial and lateral portions of the sole (only the medial side is shown in FIG. 2*a*) allow the boot to be securely engaged by the binding. The boot shown also includes a high-back support 46 that provides leverage in assisting the rider in getting on his or her heel edge. The upper portion of the boot 48 is formed from a soft material (e.g. leather or synthetic material), and is laced up the front in a conventional manner by laces 52.

In the embodiment shown in FIG. 2*a*, the strap is attached to the boot at the molded interface 44. This is advantageous because the interface is sufficiently strong to secure the strap. However, as described below, the strap can alternatively be attached to other portions of the boot, including the soft upper section, and is not limited to use with a boot including a molded interface.

The ankle strap 30 of FIG. 2*a* need not be as strong as a strap used in a conventional soft boot strap binding because the boot is secured to the board by the engagement between the step-in binding and the binding interface 42, not the strap 30. The ankle strap only prevents the heel from lifting in the boot. Thus, a relatively thin strap 30 can be used which provides the advantage of having a low-profile and non-bulky appearance that is integrated with the boot.

FIG. 3*a* illustrates a sectional view of the strap 30 of FIG. 2*a*. The strap may have a load bearing component made from a suitable non-stretch material that will not stretch significantly even when wet. Examples of such materials include a Kevlar or fiberglass band encased in a plastic coating such as Surlyn (available from DuPont), a non-stretch plastic strap formed by injection or compression molding, and a laminated non-stretch fabric die-cut to a desired shape. In the embodiment shown, the strap 30 includes a non-load bearing component. For example, the strap 30 may include a cushion material 54 (e.g., EVA foam material) to increase comfort. The cushion material may be covered with a polypropylene skin so that it does not absorb moisture, and may be disposed entirely around the strap. It should be understood that although the cushion material increases comfort, it is not required.

A second non-load bearing component such as strap piece 56 may be overlaid and attached to the outer surface of the strap 30 for decorative purposes. The second piece may be made from leather so that the strap looks integrated with the boot. Additionally, a shaggy leather piece 58 may be attached to the strap piece 56, and the strap may be provided with a debossed insignia as illustrated.

It should be understood that snowboard boots are provided in many different sizes. As mentioned above, it is desirable to integrate the strap of the present invention with the boot. However, it is also preferable to avoid the necessity of providing a differently sized strap customized for each boot size. Therefore, in one embodiment of the invention, the strap is adjustable so that the strap can be used with several boots of different sizes.

Figure 3B:
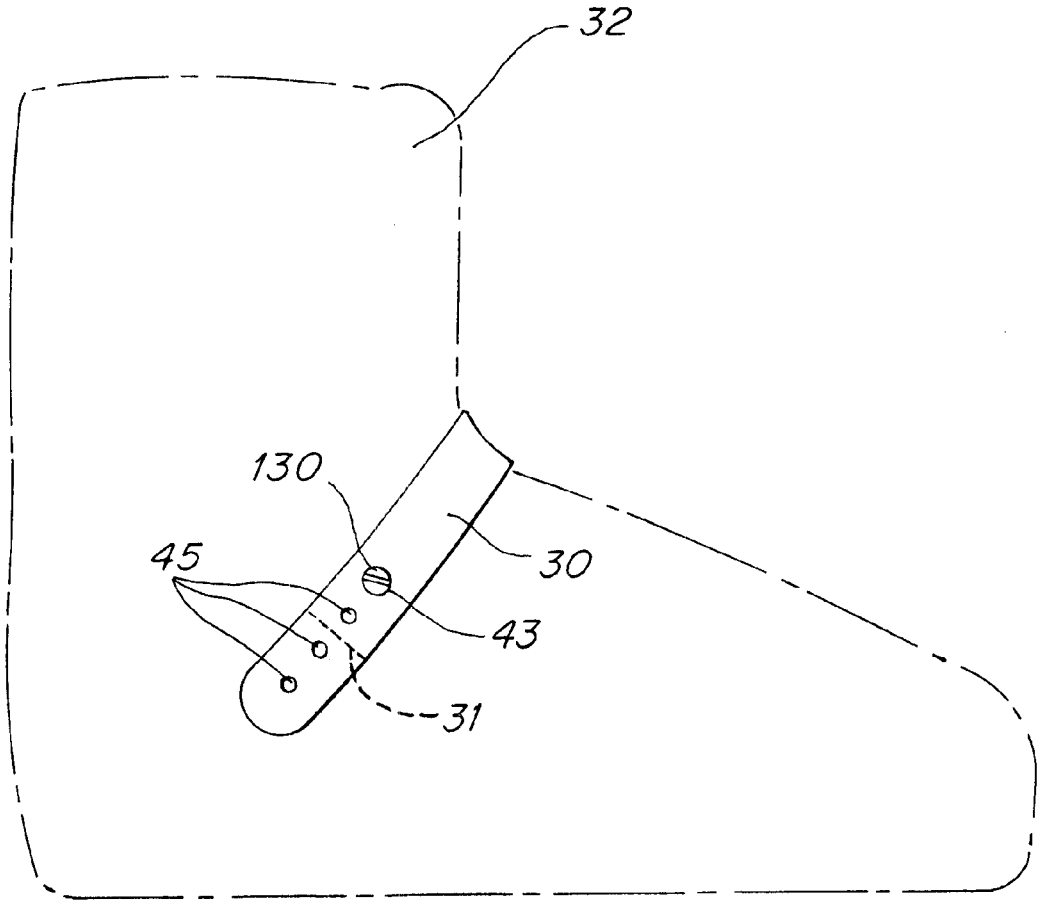
FIG. 3*b* illustrates a strap according to the present invention attached to a boot (schematically shown in phantom) and shows an adjustable feature of the strap.

An example of an adjustable strap 30 is illustrated in FIG. 3*b*. The location 43 on the strap 30 that is attached to the boot 32 (schematically shown in phantom) can be adjusted. As described in more detail below with reference to FIGS. 7*a* and 7*b*, the strap can be attached to the boot with a screw 130 that is fastened to the boot through a hole in the strap. Several holes 45 may be provided so that the most desirable fit for the strap can be selected. After the strap is adjusted to the desired fit, an excess amount of the strap 30, as suggested by dotted line 31, may be removed so that it does not extend over the end of the board. The adjustable feature of the present invention enables each strap to be used with multiple boot sizes so that the number strap sizes (e.g., four or five) can be less than the full line of boot sizes (e.g., ranging from sizes 3–13).

As shown in FIG. 2*a*, the heel strap 30 is connected at attachment locations 38 (only one is shown in FIG. 2*a*) on the boot. The placement of the attachment locations 38 can impact the performance of the strap in holding down the heel, and the rider's comfort. The placement that will maximize performance and comfort will vary depending on the rider's personal preference. The height of the attachment point above the heel and the distance forward from the heel will both impact the comfort and performance of the strap. In general, the lower and further back the attachment locations are for the strap of FIG. 2*a*, the greater the holding force.

Figure 2B:
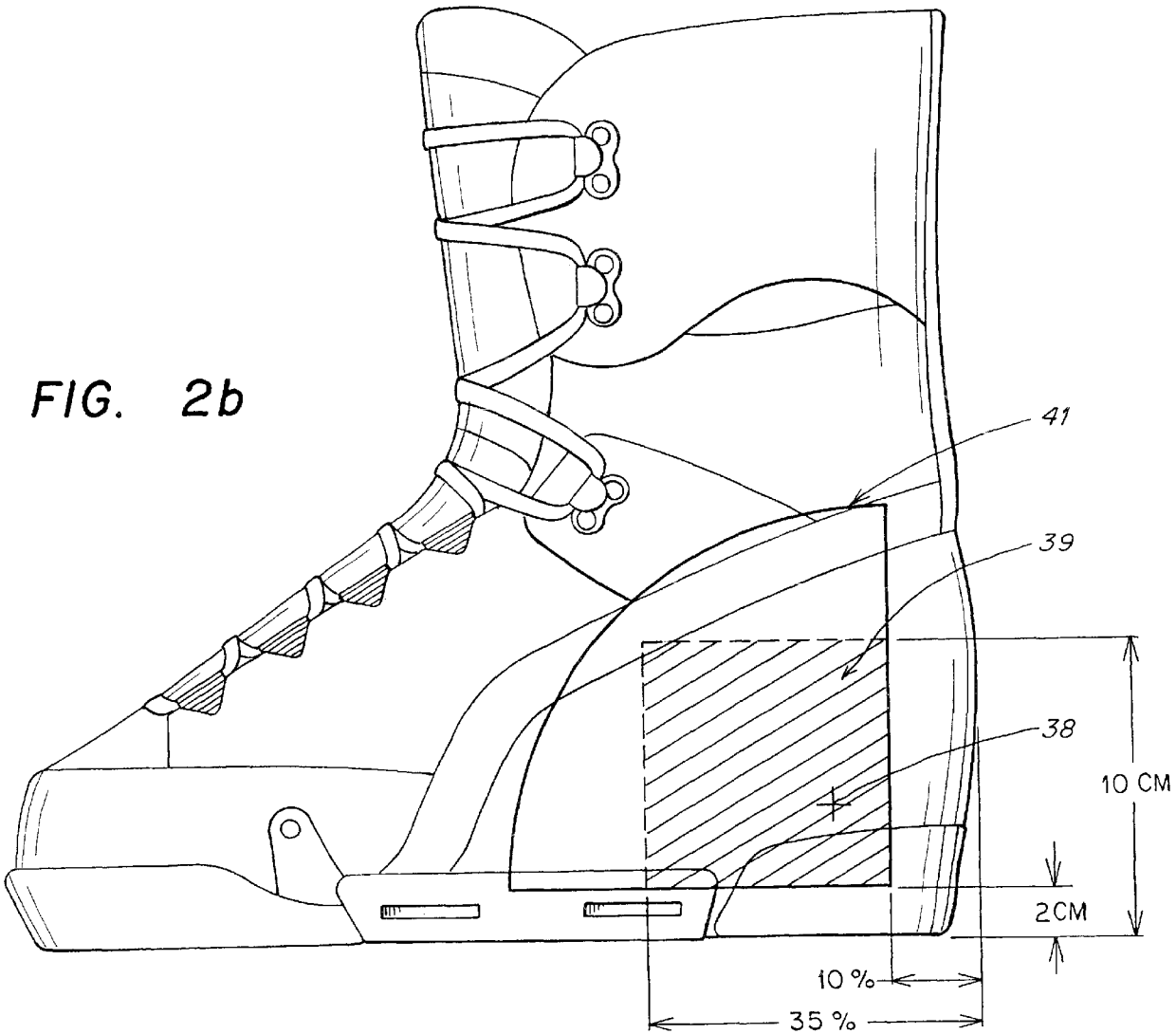
FIG. 2*b* is an illustration of a boot showing a zone of potential attachment locations for a strap according to the present invention.

FIG. 2*b* illustrates a zone of possible attachment points for the strap, represented by solid line 41. The area bounded by line 41 is approximately a quarter circle having a center disposed 2 cm up from the bottom of the sole and forward of the heel at approximately 10% of the length of the boot. The radius of the quarter circle is approximately 12 cm, although this will vary with the size of the boot. While not intended to be exclusive, it is believed that attachment points within this zone will provide satisfactory performance for the strap of the present invention. As shown in FIG. 2*b*, the attachment zone has a lower boundary that is approximately 2 cm from the bottom of the sole. The lower boundary is selected so that the attachment location does not interfere with the interface between the boot and the binding.

FIG. 2*b* also illustrates a preferred attachment zone, illustrated by shaded region 39. The preferred zone also has a lower boundary that is 2 cm from the sole bottom, and an upper boundary that is 10 cm from the sole bottom. The upper boundary is selected so that sufficient forces may be applied to hold the heel in the boot. The distance of the strap attachment point forward from the heel also affects performance. As shown in FIG. 2*b*, the preferred attachment zone 39 extends forward from the heel by approximately 10–35% of the total boot length. Although the attachment zones shown in FIG. 2*b* are believed to provide satisfactory performance, it should be understood that the present invention is not limited to attachment points within these zones. Furthermore, the configuration and width of the strap will also affect the location of the most comfortable attachment point.

Various prototypes of the strap of FIG. 2*a* have been constructed and tested. The table below lists several trial configurations used with a size 9.5 boot.

ATTACHMENT LOCATIONS

| | LATERAL SIDE | | MEDIAL SIZE | |
|---|---|---|---|---|
| SAMPLE | HEIGHT (cm) | % FROM HEEL | HEIGHT (cm) | % FROM HEEL |
| A | 5.5 | 13% | 5 | 15% |
| B | 3.5 | 25% | 5 | 26% |
| C | 6.5 | 26% | 6.0 | 25% |
| D | 3 | 23% | 5 | 26% |
| E | 3 | 28% | 4.5 | 26% |
| F | 3 | 25% | 5 | 26% |
| G | 3.5 | 28% | 5.5 | 25% |

In one embodiment of the invention, shown in FIG. 2*a*, a second strap 66 is located in a region forward of the metatarsus. The strap 66 holds the forward part of the foot in the boot so that when the rider's weight shifts toward the heel, the toes do not pull upward away from the boot bottom. As with the strap 30, strap 66 may be attached to the interface 44 or to any other portion of the boot. The strap 66 can be constructed in the same manner as strap 30, and is removable in the same manner. Although the use of the two straps 30 and 66 provides the advantages discussed above, it should be understood that the invention does not require the use of two straps.

Figure 4:
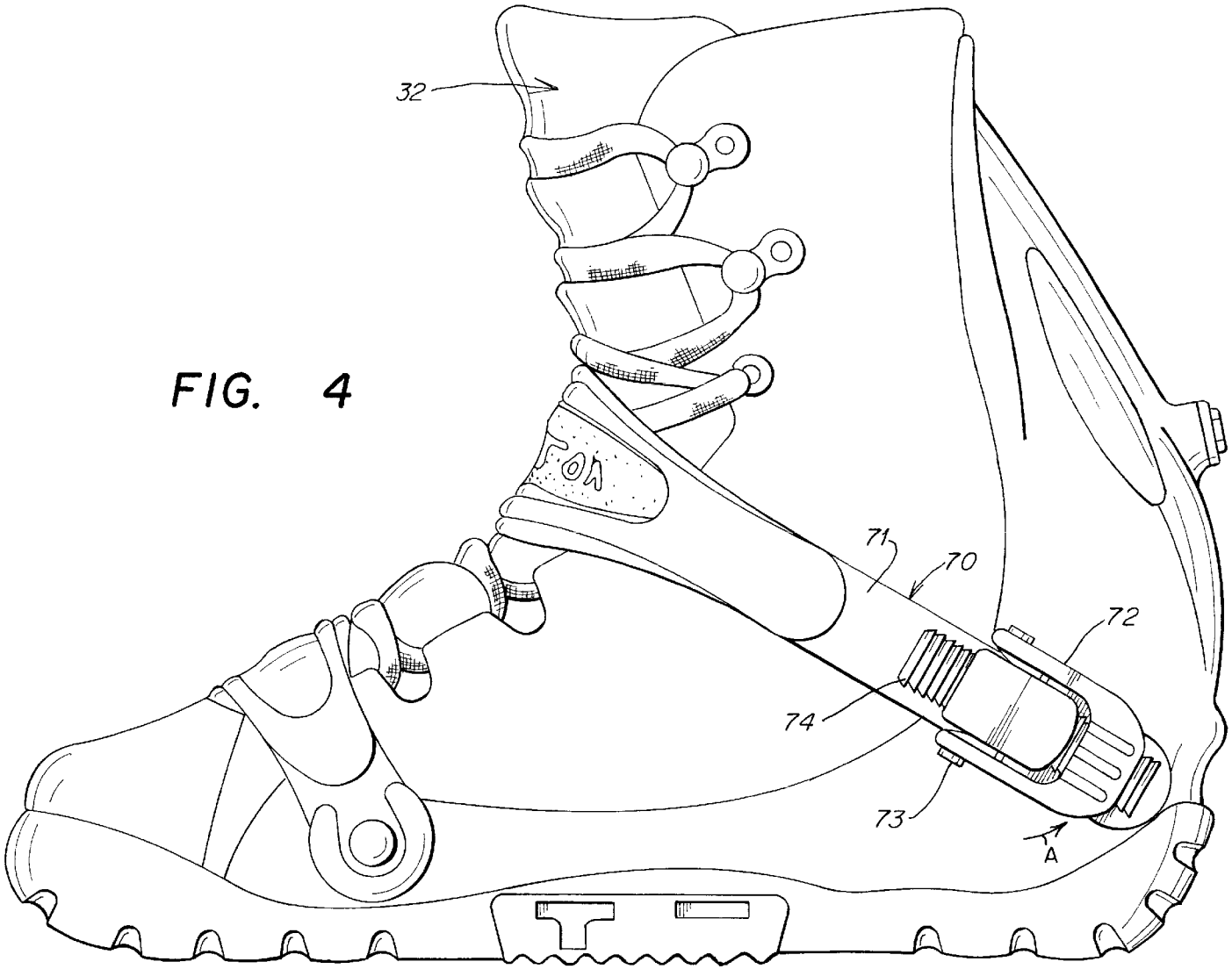
FIG. 4 is a lateral side view of an ankle strap according to the present invention and illustrates a strap locking mechanism attached to the boot.

The strap of the present invention may include a buckle or other adjustable fastening mechanism for allowing selective tightening and loosening of the strap. The strap may include a first strap portion disposed on one side of the foot and a second portion on the other, with a buckle or some other type of mating mechanism adapted to releasably secure the two strap portions. FIG. 4 shows an illustrative example of such a strap 70. The strap includes a first portion 71 that includes a plurality of transverse protrusions or teeth 74 extending upwardly therefrom. The strap further includes a second portion attached on the opposite side of the boot and including a buckle 72 adapted to releasably engage the teeth 72 of the strap portion 71. The buckle pivots relative to the second strap portion about a pin 73. To tighten the strap 70, the buckle is pivoted to an open position and the strap portion 71 is fed into the buckle until the desired tooth 74 is engaged therewith. The buckle is then rotated in the direction of arrow A (FIG. 4) to tighten down the strap.

The above-described buckle arrangement provides several advantages. First, the plurality of teeth 74 provides a level of adjustability that enables each strap to be used with boots of different sizes, which is advantageous for reasons discussed above. Second, the buckle provides a convenient mechanism for adjusting the tension on the strap. For example, when it is desired to temporarily release the tension of the strap on the rider's foot (e.g., when riding up on the lift), the buckle can be rotated to the open position without having to alter the fine positional adjustment established by the selection of a particular one of the teeth 74 for engaging the buckle.

In an alternate embodiment of the invention, the mechanism for tightening and loosening the strap is a slap-ratchet as described in U.S. Pat. No. 5,416,952, assigned to Burton Snowboards, which is incorporated herein by reference. In this embodiment, the strap 70 also has the plurality of teeth 74 that engage corresponding ratchet teeth in the slap ratchet to secure the strap at the desired tension.

Figure 5A:
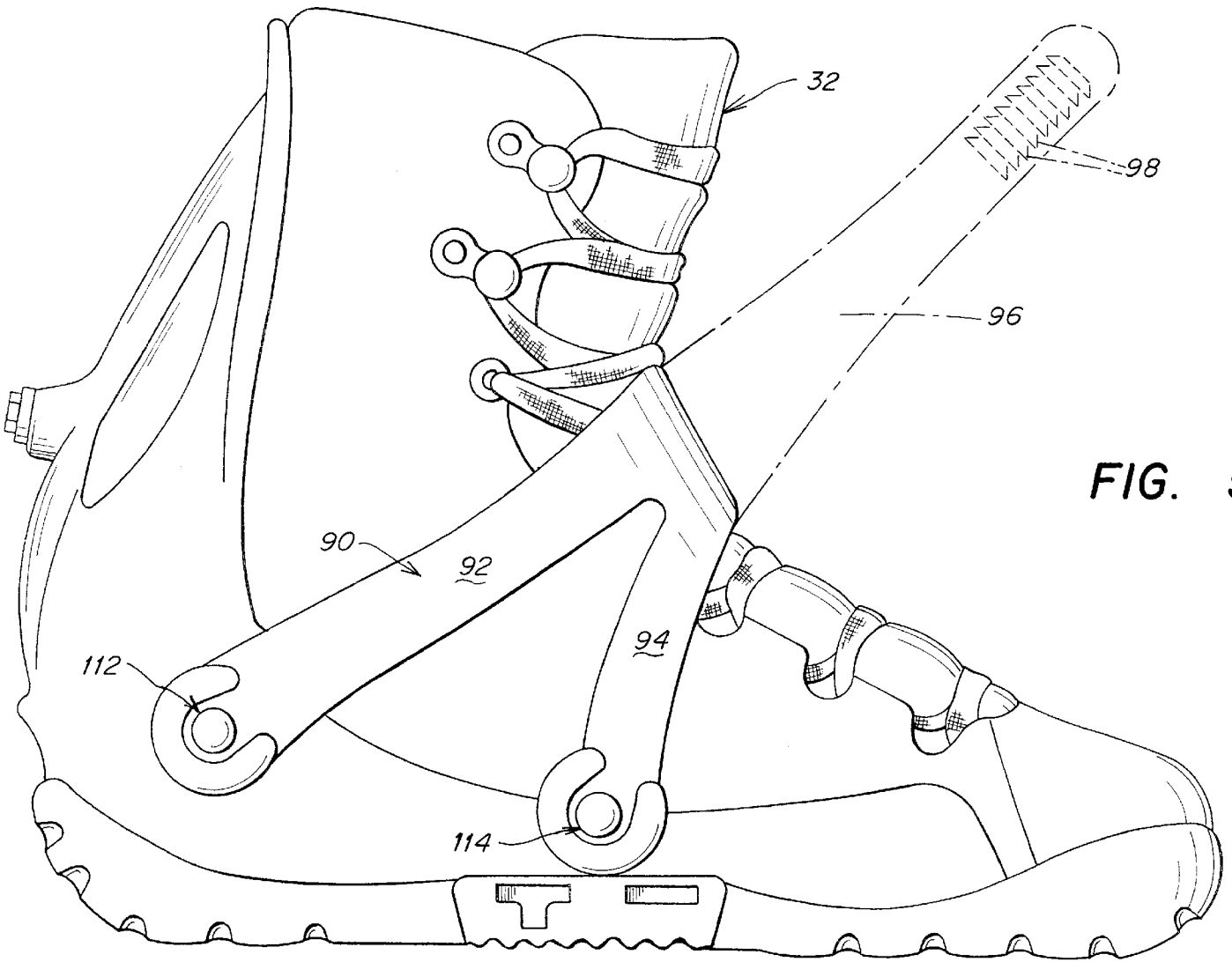
FIG. 5*a* illustrates an alternate embodiment of the ankle strap of the present invention, having a Y shape, attached to a boot.

FIG. 5*a* illustrates another aspect of the present invention wherein an ankle strap 90 is provided that secures the heel of the rider and includes means for avoiding the creation of a pressure point on the rider's instep bones (the internal cuneiform bone being the most prominent). This is achieved in the embodiment of the invention shown in FIG. 5*a* with a Y-shaped strap 90 that includes two branches 92 and 94 connected on the in-step side of the boot. The branches 92 and 94 merge at a branch 96 (shown in phantom as unsecured) that is attached on the other side (not shown) of the boot. Thus, the strap can be formed from a single piece of any of the materials discussed above as being appropriate for forming the strap of FIG. 2*a*, and can also include the cushioning and decorative features discussed above. The branch 96 includes a plurality of teeth 98 that are similar to the teeth 74 (FIG. 4) discussed above, and can be used to secure the strap to a buckle or slap rachet in the same manner as the strap 70 (FIG. 4).

In the embodiment shown in FIG. 5*a*, the Y-shaped strap 90 holds the rider's heel in the boot while spreading the force applied to the rider's foot. Thus, the strap does not create a pressure point at the instep bones of the rider. The location of the branches and the space created between them impacts the comfort of the strap. In the embodiment shown, the Y-shaped strap has one branch higher on the foot than the tarsal-metatarsal junction (proximate the location where the ankle bends), and the other branch lower on the metatarsal region. This configuration is advantageous because it avoids creating a pressure point on the instep bones. However, it should be understood that the present invention is not limited to the arrangement shown in the drawings, and that other arrangements are possible. For example, the strap can have two attachment points on both sides of the boot, or can have a single attachment point on each side with a cut-out region above the instep bones. Also, the fixation mechanisms (e.g., the buckle and mating teeth) can be reversed between branches 92 and 94 and branch 96.

The locations where the branches 92, 94 and 96 are attached to the boot can impact the comfort and performance of the strap 90. One example of a set of attachment locations is as follows: the strap branch 92 can be connected at a location 112 that is 7.5 cm from the heel and 3.7 cm from the bottom of the sole; the strap branch 94 can be connected at a location 114 that is 15.7 cm from the heel and 2.5 cm from the bottom of the sole; and the strap branch 96 can be connected at a location that is 4.5 cm from the heel and 4.5 cm from the bottom of the sole.

Figure 5B:
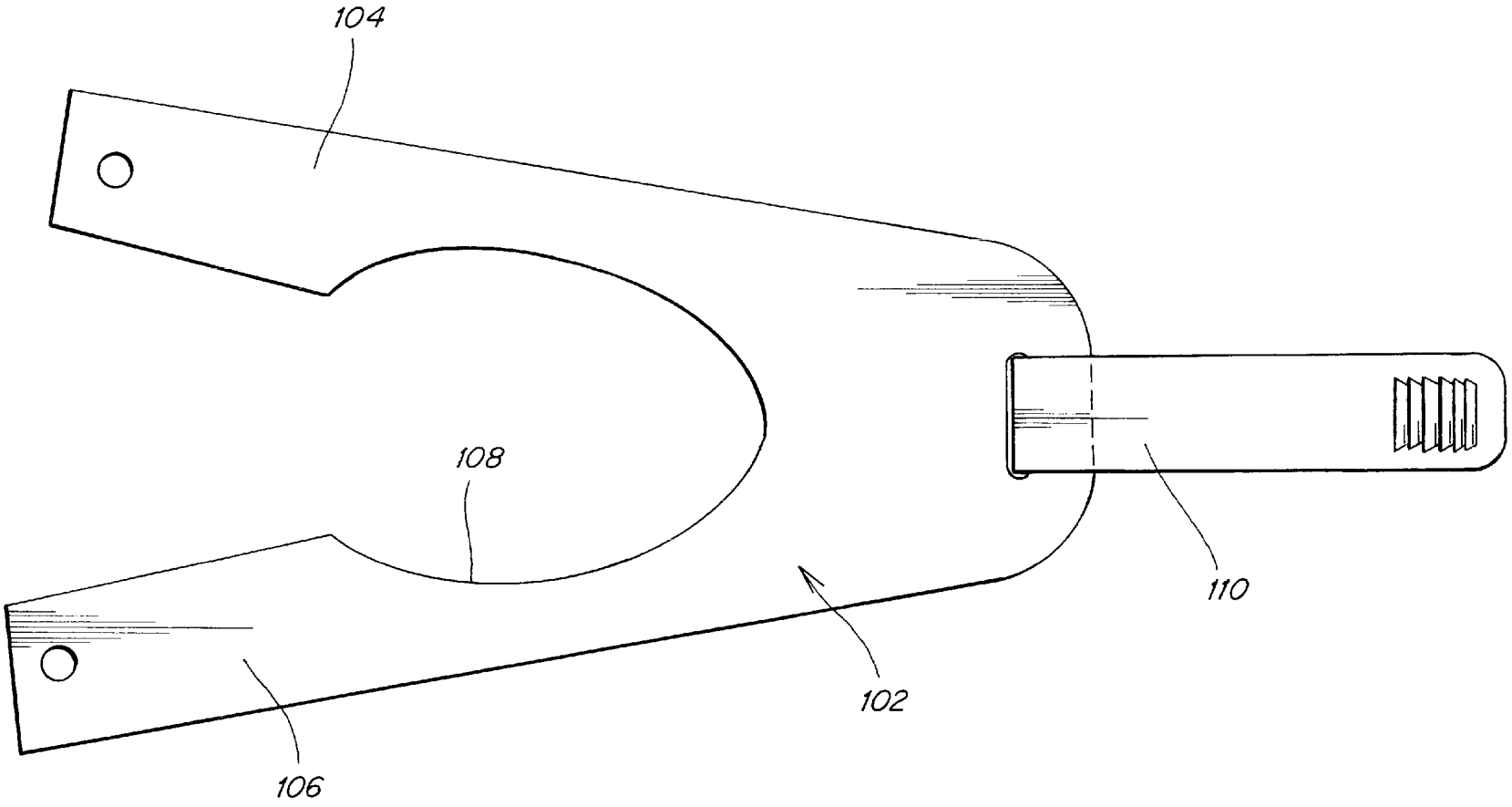
FIG. 5*b* illustrates the Y-shaped strap of FIG. 5*a;*

FIG. 5*b* illustrates another embodiment of a Y-shaped strap 102 according to the present invention. In this embodiment, branches 104 and 106 are formed from a single piece of non-stretchable material. The branches form a teardrop-shaped opening therebetween that accommodates the top of the rider's foot. A strip 110 connects the strap on the other side of the boot. The materials used may be any of those discussed above in connection with the strap of FIG. 2*a*.

The pressure relieving strap of the present invention has several applications. The strap can be attached to a snowboard boot as described above to hold down the rider's heel. In this respect, the strap can be removably attached to provide the advantages described above. However, the pressure relieving strap can alternatively be permanently fixed to the boot and would still provide advantages in terms of comfort over a prior art system such as disclosed in Meiselman. Furthermore, the pressure relieving strap can be used in any application wherein a strap is used to engage a boot or foot, such as on a soft boot strap binding.

Figure 6:
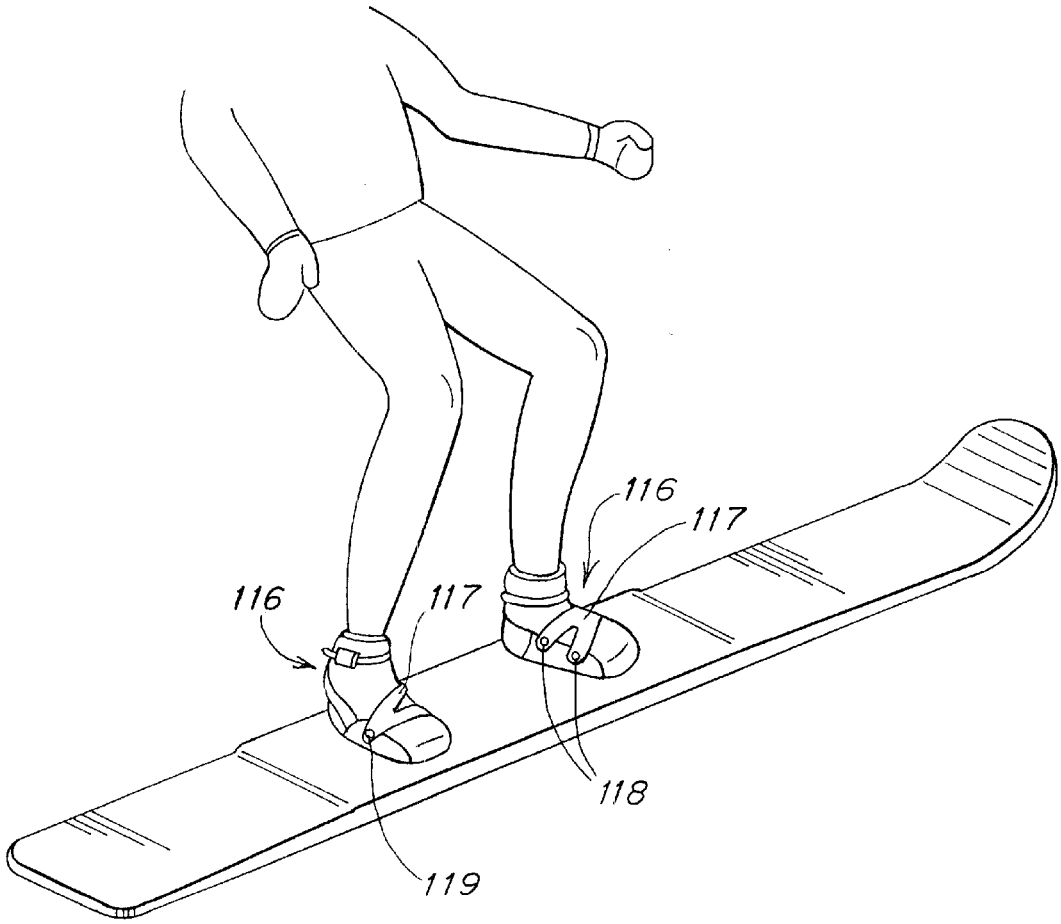
FIG. 6 illustrates a strap binding employing a Y-shaped strap in accordance with the present invention.

FIG. 6 illustrates a soft boot binding 116 that employs a Y-shaped strap 117 according to the present invention. The strap 117 has two connection points 118 on the medial side of the binding, and a single connection point 119 on the lateral side. A buckle or slap ratchet arrangement (not shown) may be used on the strap, and can be attached on the lateral side.

As discussed above, in one embodiment of the invention, a strap is removably attached to a snowboard boot so that the boot can be used either with a soft boot step-in binding or a more conventional strap binding. Many different types of strap and boot junctions can be used to make the strap removable, and that the present invention is not limited to any particular one. However, solely for the purpose of illustration, FIGS. 7–11 depict a number of different junctions for detachably connecting the strap to the boot.

Figure 7A:
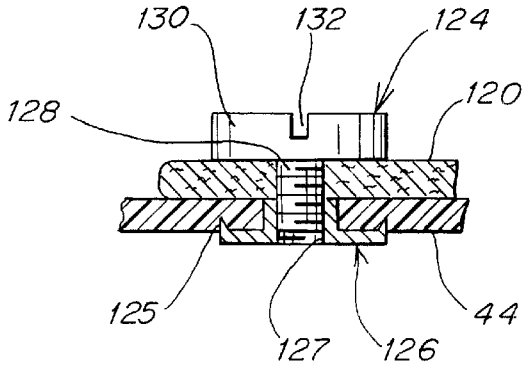
FIG. 7*a* is a cross-sectional view illustrating a screw and a T-nut that is used for attaching the strap to the boot in one embodiment of the present invention.
Figure 7B:
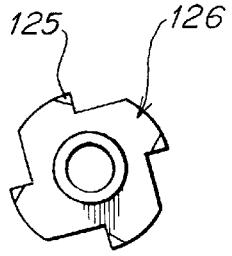
FIG. 7*b* is a top view of the T-nut of FIG. 7*a;*

FIG. 7*a* is a cross-sectional view of a first arrangement for attaching the strap to a boot. This arrangement includes a screw 124 that passes through the strap and is received by a T-nut 126 (shown in a top view in FIG. 7*b*) mounted through the boot to secure the strap 120 thereto. The T-nut may be mounted through the interface 44 (FIG. 2*a*), the upper boot 48, or any other portion of the boot that has sufficient "pull-though" strength to prevent the T-nut from being pulled through the boot when the strap is tensioned. The T-nut has internal threads 127 disposed along a central opening to receive external threads 128 on the screw, and can be anchored to the boot (e.g., by sharp protrusions 125 that engage the boot, by heat welding, or by glue) so that it does not rotate when the screw is tightened or loosened. The strap is secured to the boot by placing the screw 124 through a hole in one end of the strap, and tightening the screw into the T-nut to tightly secure the strap. The strap can be removed simply by loosening the screw. Thus, the screw securely holds the strap to the boot while enabling easy removal and re-attachment. The insert and screw of FIGS. 7*a*–7*b* are sized so that the overall length of the attachment is minimized, and to ensure that the attachment does not protrude significantly from the surface of the boot. The screw 124 can also have a flat head 130, and a slot 132 sized so that a small coin can be used to tighten/loosen the screw so that a screwdriver is unnecessary. Of course, any other type of screw can also be used.

Figure 8A:
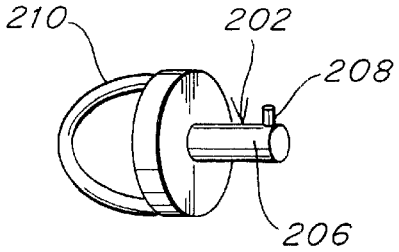
FIGS. 8*a*, 8*b* and 8*c* each illustrates an alternate mechanism for connecting the strap and the boot.
Figure 8B:
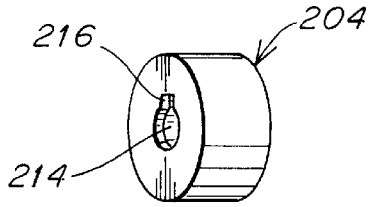
Figure 8C:
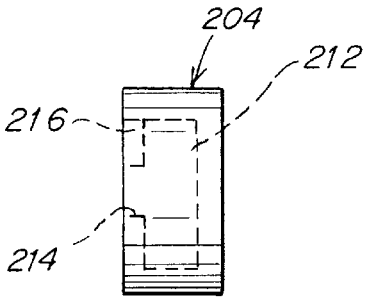

FIGS. 8*a*, 8*b*, and 8*c* illustrate another embodiment of a connector that can be used to attach the strap to the boot. In this embodiment, a key-type fastener is used. An example of a suitable key-type fastener is available under the Trademark DZUS. As shown in FIGS. 8*a* and 8*b*, the fastener includes a key 202 and a lock 204 that is attached to the boot. The key 202 has a shaft 206 with a protrusion 208 extending radially therefrom, and a semicircular handle 210 that enables the key to be held and turned as desired. The lock 204 is a substantially flat circular piece having an interior cavity 212 as illustrated in FIG. 8*c*. The lock 204 has central opening 214 that is sized to receive the key shaft 206. The central opening has a cut out 216 shaped to receive the protrusion 208 of the key such that the key will only be received in the lock when the protrusion 208 is oriented with the cut out 216. Once within the lock, the key may be turned to secure the key in the lock. The key-type fastener can be used to secure the strap to the boot by disposing the lock 204 on the boot in a desired attachment location. The key shaft is passed through a hole in the strap so that when the key is secured within the lock, the strap is secured at the desired location.

Figure 9A:
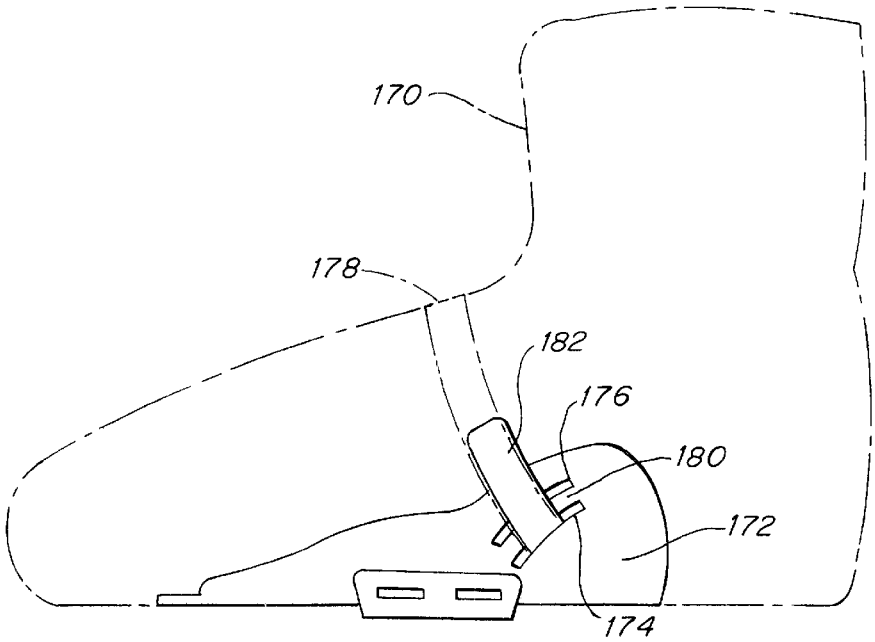
FIGS. 9*a*, 9*b* and 9*c* illustrate a further embodiment of a mechanism for connecting the strap to the boot.

FIG. 9*a* illustrates a schematic view of another type of connection between the strap and boot. In this embodiment, the boot 170 (shown in phantom) has a molded binding interface 172 that includes slots 174 and 176 for receiving the strap. While the slots are shown as being curved, they can also be straight. The long direction of the slots can be angled with respect to the sole of the boot as illustrated. The strap 178, shown partially in phantom, is passed into one slot and out the other so that an intermediate piece 180 of the boot holds the strap in place. The free end 182 of the strap can be attached to the boot to secure the strap. Alternatively, the strap can be secured by doubling it back on itself as shown in FIG. 9*c*, which illustrates the free end 182 doubled back and attached to the strap 178. The free end can be attached to the strap in any number of ways, e.g., with snaps or with hook and loop fasteners.

Figure 9B:
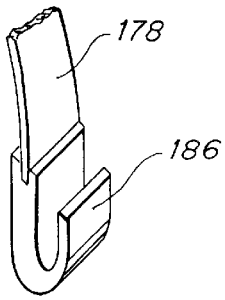
Figure 9C:
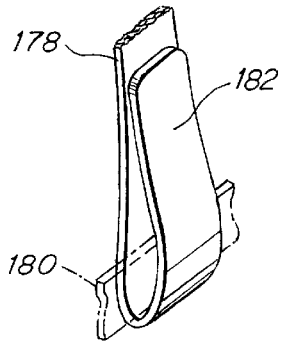

FIG. 9*b* illustrates a further alternate arrangement wherein a hook 186 is attached to the end of the strap 178 to secure the strap to a slot such as 174 or 176 in the boot. The hook is configured to correspond to the slot to facilitate entry and may be made of a suitable rigid or semi-rigid plastic material. Multiple slots can be employed to enable the effective length of the strap to be adjusted.

Figure 10:
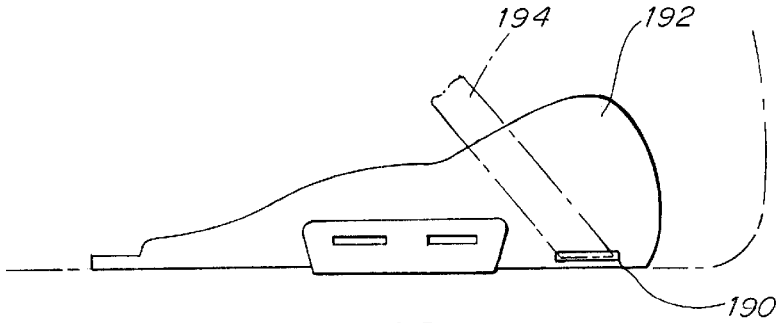
FIG. 10 illustrates another embodiment of a mechanism of connection between the boot and the strap wherein a one-piece strap is fed through a passageway in the boot.

FIG. 10 illustrates another embodiment for attaching the strap to the boot. In this embodiment, a passage 190 is formed through the boot so that a strap 194, shown in phantom, may extend under the rider's foot through the passage 190. The passage can be provided, as shown, through a molded binding interface 192 of the boot. Alternatively, the passage 190 can be provided through the sole of the boot. The strap may be a single piece that extends all the way through the interface passage, with the free ends being attached in the front of the boot. The free ends can be releasably engaged using any of the connection mechanisms discussed above.

Figure 11:
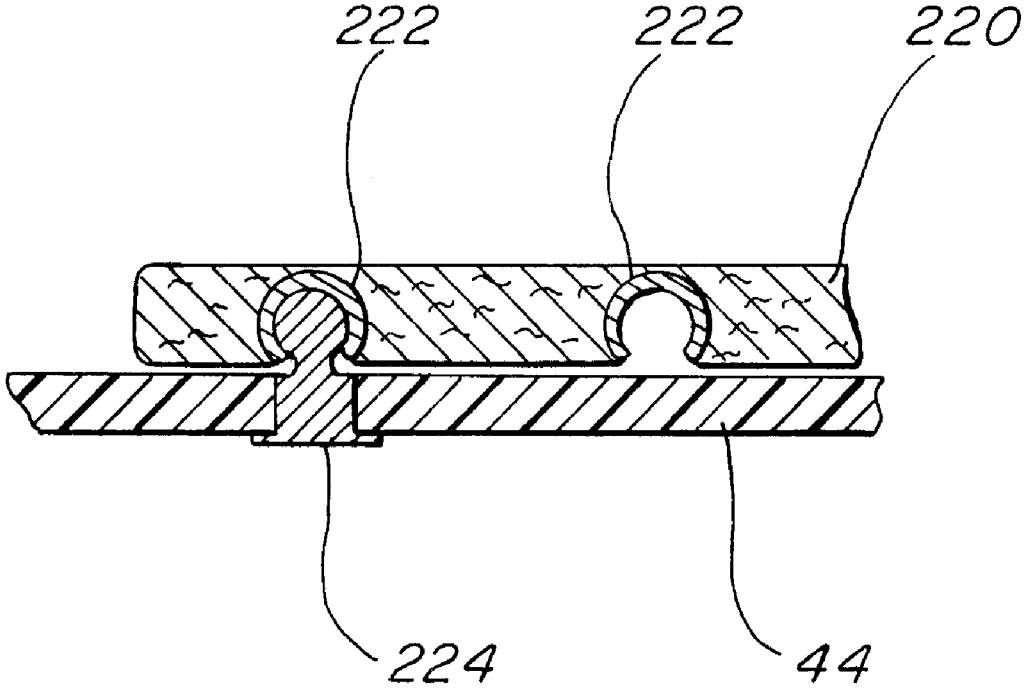
FIG. 11 illustrates still another mechanism for connecting the strap and the boot wherein a snap-type fastener is used.

FIG. 11 illustrates a further arrangement for connecting the strap to the boot. This arrangement consists of a snap-type connection wherein the strap 220 and boot 44 include mating female and male snap connectors 222 and 224. The male connector can be attached to the boot at the interface 44 or elsewhere by any suitable means, such as heat welding or glue. The strap can have a plurality of snaps to provide adjustability in much the same manner as discussed above. Of course, it should be recognized that the male and female connectors can be reversed so that the male connector is attached to the strap and the female connector to the boot.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

What is claimed is:

1. An apparatus comprising:

a snowboard boot having an upper at least partially made of relatively soft material;

a strap including a first end, a second end, and an adjustable fastener that is engageable with the second end to allow selective tightening and loosening of the strap; and attachment means for removably attaching the strap to the snowboard boot, the attachment means including means for enabling the first end of the strap to be attached, removed and reattached at a first attachment location of the snowboard boot, and means for enabling the adjustable fastener to be attached, removed and reattached at a second attachment location of the snowboard boot;

wherein when the first end and the adjustable fastener are attached to the snowboard boot and the second end is engaged with the adjustable fastener, the strap extends across a portion of the snowboard boot, to inhibit a portion of a rider's foot from lifting in the snowboard boot;

wherein the boot includes an instep area corresponding to an in step bone of a rider and the strap includes a first portion that extends above the instep area of the boot and a second portion that extends below the instep area, the first and second portions being separated by a gap defined therebetween, the gap being arranged to overlie the instep area of the boot so that the first and second portions of the strap avoid creation of a pressure point on the instep area of the boot.

2. The apparatus of claim 1, wherein the strap is a heel strap, and wherein the first and second attachment locations are arranged on the snowboard boot so that when the first end is attached to the first attachment location, the adjustable fastener is attached at the second attachment location and the second end is engaged with the adjustable fastener, the strap is arranged to prevent the rider's heel from lifting in the snowboard boot.

3. The apparatus of claim 1, wherein the adjustable fastener includes a buckle to adjust tension in the strap.

4. The apparatus of claim 1, wherein the snowboard boot includes a heel and a sole, and wherein the first and second attachment locations each is disposed within a range from approximately 10% to approximately 35% of a length of the snowboard boot measured from the heel.

5. The apparatus of claim 4, wherein the first and second attachment locations each is disposed within a range from approximately 2 cm to approximately 10 cm from a bottom of the sole.

6. The apparatus of claim 1, wherein the snowboard boot includes a heel and a sole, and wherein the first and second attachment locations each is disposed within a range from approximately 2 cm to approximately 10 cm from a bottom of the sole.

7. The apparatus of claim 1, further comprising means for adjusting a position of the strap with respect to the snowboard boot.

8. The apparatus of claim 7, wherein the gap defines an opening in the strap so that no portion of the strap overlies the instep area of the boot.

9. The apparatus of claim 1, wherein the means for removably attaching the strap to the snowboard boot includes a first fastener supported by the strap and a second fastener disposed on the snowboard boot, the first and second fasteners interlocking to attach the strap to the snowboard boot.

10. The apparatus of claim 9, wherein the first fastener is a male connector and the second fastener is a female connector.

11. The apparatus of claim 1, wherein the snowboard boot has an upper and a sole, and wherein the upper is formed from a soft material.

12. The apparatus of claim 11, wherein the snowboard boot includes at least one feature adapted to cooperate with a step-in snowboard binding.

13. The apparatus of claim 11, wherein the snowboard boot upper has a laced front.

14. The apparatus of claim 13 wherein the snowboard boot includes at least one feature adapted to cooperate with a step-in snowboard binding.

15. The apparatus of claim 1, wherein the snowboard boot includes at least one feature adapted to cooperate with a step-in snowboard binding.

16. The apparatus of claim 15, wherein the snowboard boot upper has a lace up front.

17. The apparatus of claim 1, wherein the snowboard boot upper has a lace up front.

18. An apparatus comprising:

a snowboard boot having an upper at least partially made of relatively soft material;

a strap including a first end, a second end, and an adjustable fastener that is engageable with the second end to allow selective tightening and loosening of the strap; and attachment means for removably attaching the strap to the snowboard boot, the attachment means including means for enabling the first end of the strap to be attached, removed and reattached at a first attachment location of the snowboard boot, and means for enabling the adjustable fastener to be attached, removed and reattached at a second attachment location of the snowboard boot;

wherein when the first end and the adjustable fastener are attached to the snowboard boot and the second end is engaged with the adjustable fastener, the strap extends across a portion of the snowboard boot, to inhibit a portion of a rider's foot from lifting in the snowboard boot;

wherein the strap further includes a third end, and wherein the attachment means further includes means for enabling the third end of the strap to be attached, removed and reattached at a third attachment location of the snowboard boot.

19. An apparatus, comprising:

a snowboard boot;

a strap including a first end, a second end, and an adjustable fastener that is engageable with the second end to allow selective tightening and loosening of the strap; and attachment means for removably attaching the strap to the snowboard boot, the attachment means including means for enabling the first end of the strap to be attached, removed and reattached at a first attachment location of the snowboard boot, and means for enabling the adjustable fastener to be attached, removed and reattached at a second attachment location of the snowboard boot;

wherein when the first end and the adjustable fastener are attached to the snowboard boot and the second end is engaged with the adjustable fastener, the strap extends across a portion of the snowboard boot, to inhibit a portion of a rider's foot from lifting in the snowboard boot;

wherein the boot includes an instep area corresponding to an in step bone of a rider and the strap includes a first portion that extends above the instep area of the boot and a second portion that extends below the instep area, the first and second portions being separated by a gap defined therebetween, the gap being arranged to overlie the instep area of the boot so that the first and second portions of the strap avoid creation of a pressure point on the instep area of the boot; and wherein the strap is Y-shaped.

20. An apparatus comprising:

a snowboard boot having an instep area corresponding to an instep bone of a rider; and a strap, attachable to the snowboard boot, to extend across a portion of the snowboard boot and inhibit a rider's heel from lifting in the snowboard boot, the strap including a first portion that extends above the instep area of the boot and a second portion that extends below the instep area, the first and second portions being separated by a gap defined therebetween, the gap being arranged to overlie the instep area of the boot so that the first and second portions of the strap avoid creation of a pressure point on the instep area of the boot.

21. The apparatus of claim 20, wherein the snowboard boot has a lateral side and a medial side, and wherein the strap is attached at a first location on the lateral side of snowboard boot and a second location on the medial side of the snowboard boot.

22. The apparatus of claim 21, wherein the snowboard boot includes a heel and a sole, and wherein the first and second attachment locations each is disposed within a range from approximately 10% to approximately 35% of a length of the snowboard boot measured from the heel.

23. The apparatus of claim 22, wherein the first and second attachment locations each is disposed within a range from approximately 2 cm to approximately 10 cm from a bottom of the sole.

24. The apparatus of claim 21, wherein the snowboard boot includes a heel and a sole, and wherein the first and second attachment locations each is disposed within a range from approximately 2 cm to approximately 10 cm from a bottom of the sole.

25. The apparatus of claim 20, wherein the strap is attached to the snowboard boot at first, second and third attachment locations.

26. The apparatus of claim 20, further comprising means for adjusting a position of the strap with respect to the snowboard boot.

27. The apparatus of claim 20, wherein the gap defines an opening in the strap so that the strap has no portion thereof that overlies the instep area of the boot.

28. The apparatus of claim 20, further comprising means for removably attaching the strap to the snowboard boot so that the strap may be attached, removed and reattached to the snowboard boot.

29. The apparatus of claim 28, wherein the strap includes a first end, a second end, and an adjustable fastener that is engageable with the second end to allow selective tightening and loosening of the strap, and wherein the means for removably attaching the strap to the snowboard boot includes means for removably attaching the first end of the strap such that the first end of the strap can be removed and reattached at a first location of the snowboard boot and means for removably attaching the adjustable fastener of the strap such that the adjustable fastener can be removed and reattached at a second location of the snowboard boot.

30. The apparatus of claim 28, wherein the means for removably attaching the strap to the snowboard boot includes a first fastener supported by the strap and a second fastener disposed on the snowboard boot, the first and second fasteners interlocking to attach the strap to the snowboard boot.

31. The apparatus of claim 30, wherein the first fastener is a male connector and the second fastener is a female connector.

32. An apparatus comprising:

a snowboard boot having an instep area corresponding to an instep bone of a rider; and a strap, attachable to the snowboard boot, to extend across a portion of the snowboard boot and inhibit a rider's heel from lifting in the snowboard boot, the strap including a first portion that extends above the instep area of the boot and a second portion that extends below the instep area, the first and second portions being separated by a gap defined therebetween, the gap being arranged to overlie the instep area of the boot so that the first and second portions of the strap avoid creation of a pressure point on the instep area of the boot;

wherein the strap is Y-shaped.

33. An apparatus comprising:

a snowboard boot:

a strap including a first end, a second end, and an adjustable fastener that is engageable with the second end to allow selective tightening and loosening of the strap; and attachment means for removably attaching the strap to the snowboard boot, the attachment means including means for enabling the first end of the strap to be attached, removed and reattached at a first attachment location of the snowboard boot, and means for enabling the adjustable fastener to be attached, removed and reattached at a second attachment location of the snowboard boot;

wherein when the first end and the adjustable fastener are attached to the snowboard boot and the second end is engaged with the adjustable fastener, the strap extends across a portion of the snowboard boot, to inhibit a portion of a rider's foot from lifting in the snowboard boot, wherein the boot includes an instep area corresponding to an in step bone of a rider and the strap includes a first portion that extends above the instep area of the boot and a second portion that extends below the instep area, the first and second portions being separated by a gap defined therebetween, the gap being arranged to overlie the instep area of the boot so that the first and second portions of the strap avoid creation of a pressure point on the instep area of the boot;

wherein the gap defines an opening in the strap so that no portion of the strap overlies the instep area of the boot; and wherein the opening has a teardrop shape.

34. An apparatus comprising:

a snowboard boot having an instep area corresponding to an instep bone of a rider; and a strap, attachable to the snowboard boot, to extend across a portion of the snowboard boot and inhibit a rider's heel from lifting in the snowboard boot, the strap including a first portion that extends above the instep area of the boot and a second portion that extends below the instep area, the first and second portions being separated by a gap defined therebetween, the gap being arranged to overlie the instep area of the boot so that the first and second portions of the strap avoid creation of a pressure point on the instep area of the boot;

wherein the gap defines an opening in the strap so that the strap has no portion thereof that overlies the instep area of the boot; and wherein the opening has a teardrop shape.

35. An apparatus comprising:

a snowboard boot having an upper at least partially made of relatively soft material;

a strap, including a first end, a second end, and an adjustable fastener that is engageable with the second end to allow selective tightening and loosening of the strap; and an attachment system to removably attach the strap to the snowboard boot, the attachment system including a first fastener engageable with the first end of the strap so that the first end of the strap can be attached, removed and reattached at a first attachment location of the snowboard boot using the first fastener, and a second fastener engageable with the adjustable fastener such that the adjustable fastener can be attached, removed and reattached at a second attachment location of the snowboard boot using the second fastener;

wherein when the first end and the adjustable fastener are attached to the snowboard boot and the second end is engaged with the adjustable fastener, the strap extends across a portion of the snowboard boot to inhibit a portion of a rider's foot from lifting in the snowboard boot;

wherein the strap further includes a third end, and wherein the attachment system includes a third fastener engageable with the third end of the strap so that the third end of the strap can be attached, removed and reattached at a third attachment location of the snowboard boot.

36. An apparatus comprising:

a snowboard boot having an upper at least partially made of relatively soft material;

a strap, including a first end, a second end, and an adjustable fastener that is engageable with the second end to allow selective tightening and loosening of the strap; and an attachment system to removably attach the strap to the snowboard boot, the attachment system including a first fastener engageable with the first end of the strap so that the first end of the strap can be attached, removed and reattached at a first attachment location of the snowboard boot using the first fastener, and a second fastener engageable with the adjustable fastener such that the adjustable fastener can be attached, removed and reattached at a second attachment location of the snowboard boot using the second fastener;

wherein when the first end and the adjustable fastener are attached to the snowboard boot and the second end is engaged with the adjustable fastener, the strap extends across a portion of the snowboard boot to inhibit a portion of a rider's foot from lifting in the snowboard boot;

wherein the boot includes an instep area corresponding to an instep bone of the rider and the strap includes a load bearing component having a first load bearing portion that extends above the instep area of the boot and a second load bearing portion that extends below the instep area, the first and second load bearing portions being separated by a gap in the load bearing component, the gap being arranged to overlie the instep area of the boot so that the load bearing component avoids creation of a pressure point on the instep area of the boot.

37. The apparatus of claim 36, wherein the strap is a heel strap, and wherein the first and second attachment locations are arranged on the snowboard boot so that when the first end is attached to the first attachment location, the adjustable fastener is attached at the second attachment location and the second end is engaged with the adjustable fastener, the strap is arranged to prevent the rider's heel from lifting in the snowboard boot.

38. The apparatus of claim 36, wherein the adjustable fastener includes a buckle to adjust tension in the strap.

39. The apparatus of claim 36, wherein the gap defines an opening in the strap so that the strap has no portion thereof that overlies the instep area of the boot.

40. The apparatus of claim 36, wherein the snowboard boot has an upper and a sole, and wherein the upper is formed from a soft material.

41. The apparatus of claim 40, wherein the snowboard boot includes at least one feature adapted to cooperate with a step-in snowboard binding.

42. The apparatus of claim 40, wherein the snowboard boot upper has a lace up front.

43. The apparatus of claim 42, wherein the snowboard boot includes at least one feature adapted to cooperate with a step-in snowboard binding.

44. The apparatus of claim 36, wherein the snowboard boot includes at least one feature adapted to cooperate with a step-in snowboard binding.

45. The apparatus of claim 44, wherein the snowboard boot upper has a lace up front.

46. The apparatus of claim 36, wherein the snowboard boot upper has a lace up front.

47. An apparatus, comprising:

a snowboard boot;

a strap, including a first end, a second end, and an adjustable fastener that is engageable with the second end to allow selective tightening and loosening of the strap; and an attachment system to removably attach the strap to the snowboard boot, the attachment system including a first fastener engageable with the first end of the strap so that the first end of the strap can be attached, removed and reattached at a first attachment location of the snowboard boot using the first fastener, and a second fastener engageable with the adjustable fastener such that the adjustable fastener can be attached, removed and reattached at a second attachment location of the snowboard boot using the second fastener;

wherein when the first end and the adjustable fastener are attached to the snowboard boot and the second end is engaged with the adjustable fastener, the strap extends across a portion of the snowboard boot to inhibit a portion of a rider's foot from lifting in the snowboard boot;

wherein the boot includes an instep area corresponding to an instep bone of the rider and the strap includes a load bearing component having a first load bearing portion that extends above the instep area of the boot and a second load bearing portion that extends below the instep area, the first and second load bearing portions being separated by a gap in the load bearing component, the gap being arranged to overlie the instep area of the boot so that the load bearing component avoids creation of a pressure point on the instep area of the boot; and wherein the strap is Y-shaped.

48. An apparatus comprising:

a snowboard boot;

a strap, including a first end, a second end, and an adjustable fastener that is engageable with the second end to allow selective tightening and loosening of the strap; and an attachment system to removably attach the strap to the snowboard boot, the attachment system including a first fastener engageable with the first end of the strap so that the first end of the strap can be attached, removed and reattached at a first attachment location of the snowboard boot and a second fastener engageable with the adjustable fastener such that the adjustable fastener can be attached, removed and reattached at a second attachment location of the snowboard boot;

wherein when the first end and the adjustable fastener are attached to the snowboard boot and the second end is engaged with the adjustable fastener, the strap extends across a portion of the snowboard boot to inhibit a portion of a rider's foot from lifting in the snowboard boot;

wherein the boot includes an instep area corresponding to an instep bone of the rider and the strap includes a load bearing component having a first load bearing portion that extends above the instep area of the boot and a second load bearing portion that extends below the instep area, the first and second load bearing portions being separated by a gap in the load bearing component, the gap being arranged to overlie the instep area of the boot so that the load bearing component avoids creation of a pressure point on the instep area of the boot;

wherein the gap defines an opening in the strap so that the strap has no portion thereof that overlies the instep area of the boot; and wherein the opening has a teardrop shape.

49. An apparatus, comprising:

a snowboard boot having an instep area corresponding to an instep bone of a rider; and a strap that is attachable to the snowboard boot to extend across a portion of the snowboard boot and inhibit a heel of the rider from lifting in the snowboard boot, the strap having a load bearing component including a first load bearing portion to extend above the instep area of the boot and a second load bearing portion to extend below the instep area, the first and second load bearing portions being separated by a gap in the load bearing component, the gap being arranged to overlie the instep area of the boot so that the load bearing component avoids creation of a pressure point on the instep area of the boot.

50. The apparatus of claim 49, wherein the strap further comprises a non-load bearing component attached to the load bearing component.

51. The apparatus of claim 50, wherein the non-load bearing component is a cushioning layer.

52. The apparatus of claim 51, wherein the cushioning layer is disposed between the snowboard boot and the load bearing component.

53. The apparatus of claim 49, wherein the non-load bearing component is disposed within the gap in the load bearing component.

54. The apparatus of claim 49, wherein the gap defines an opening in the load bearing component so that no portion of the load bearing component overlies the instep area of the boot.

55. An apparatus, comprising:

a snowboard boot having an upper at least partially made of relatively soft material and having an instep area corresponding to an instep bone of a rider; and a strap that is attachable to the snowboard boot to extend across a portion of the snowboard boot and inhibit a heel of the rider from lifting in the snowboard boot, the strap including means for avoiding the creation of a pressure point on the instep area of the boot.

56. A method of attaching a strap to a snowboard boot to inhibit a rider's heel from lifting in the snowboard boot, the snowboard boot having an instep area corresponding to an instep bone of the rider, the strap having a load bearing component including first and second load bearing portions and a gap disposed therebetween, the method comprising steps of:

disposing the first load bearing portion along the boot at a first portion above the instep area of the boot;

disposing the second load bearing portion along the boot at a second portion below the instep area of the boot; and positioning the gap over the instep area of the boot so that the load bearing component of the strap avoids creation of a pressure point on the instep area of the boot.

57. The method of claim 56, further comprising a step of positioning the load bearing component so that no portion thereof overlies the instep area of the boot.

* * * * *